US005726426A

United States Patent [19]

Davis et al.

[11] Patent Number: 5,726,426

[45] Date of Patent: Mar. 10, 1998

[54] MICROWAVEABLE FOOD CONTAINER WITH PERFORATED LID

[75] Inventors: Jeffrey Martin Davis, Liss Forest; Peter Bowler, Oxfordshire; Kenneth David Woods, West Yorkshire, all of England

[73] Assignee: Ranks Hovis McDougall Limited, Berkshire, England

[21] Appl. No.: 392,982

[22] PCT Filed: Sep. 8, 1993

[86] PCT No.: PCT/GB93/01905

§ 371 Date: Jun. 26, 1995

§ 102(e) Date: Jun. 26, 1995

[87] PCT Pub. No.: WO94/05563

PCT Pub. Date: Mar. 17, 1994

[30] Foreign Application Priority Data

Sep. 9, 1992 [GB] United Kingdom ..... 9219109

[51] Int. Cl.[6] ..... H05B 6/80; B65D 81/34

[52] U.S. Cl. ..... 219/730; 219/735; 426/234; 426/107; 99/DIG. 14

[58] Field of Search ..... 219/730, 734, 219/735, 759, 725; 426/107, 243, 234; 99/DIG. 14

[56] References Cited

U.S. PATENT DOCUMENTS

| | | | |
|---|---|---|---|
| 4,835,352 | 5/1989 | Sasaki et al. | 219/730 |
| 5,053,594 | 10/1991 | Thota et al. | 219/725 |
| 5,132,151 | 7/1992 | Graney | 219/734 |
| 5,310,977 | 5/1994 | Stenkamp et al. | 219/730 |
| 5,317,120 | 5/1994 | Bunke et al. | 219/730 |

FOREIGN PATENT DOCUMENTS

| | | |
|---|---|---|
| 0 270 838 A1 | 6/1988 | European Pat. Off. . |
| WO 83/00476 | 2/1983 | WIPO . |

*Primary Examiner*—Philip H. Leung

*Attorney, Agent, or Firm*—Nawrocki, Rooney & Sivertson, P.A.

[57] ABSTRACT

A container for use in connection with the exposure of edible matter to microwave radiation. The container comprises a base tray and a lid. The lid is formed from a sheet of material which absorbs microwave radiation and is heated by it, and has a plurality of openings formed in it to allow escape of moisture during heating of the product. The lid is so folded or constructed that the distance through the openings from one side to the other side of the lid is greater then the thickness of the material of the lid.

19 Claims, 5 Drawing Sheets

MICROWAVEABLE FOOD CONTAINER WITH PERFORATED LID

This invention relates to a container for use in connection with the exposure of a product to microwave radiation, and to a method of exposing edible matter to microwave radiation.

A product which is heated by microwave radiation is heated effectively from within the body of the product. The product is exposed to air which is cool and humid, compared with that to which a product might be exposed to in a conventional oven. Moreover, the period in which a product is exposed to microwave radiation in a microwave oven is generally very much less than the period of exposure to heat in a conventional oven. As a result, it is often found that it is not possible for adequate moisture to be lost from a product which is heated by exposure to microwave radiation so that, in the case of certain products, in particular edible products which are required to have a crisp external surface layer, the surface layer can be soggy and generally devoid of crispness.

A number of packaging materials have been developed for use with microwave appliances in order to alleviate this problem. Such packaging materials include several materials capable of absorbing microwave energy, and converting that energy to heat. They are sometimes referred to as "microwave heat-reactive materials". The food product in question is covered, preferably enveloped, by the packaging material, and then sears due to exposure to the heat generated within the material by the microwave radiation.

A known such packaging material is disclosed in EP-A-270838. It comprises a plastic film having a thin metallic coating applied to it. The film has a plurality of slits in the form of broken lines, in parallel, formed in it. The slits allow the material to be deformed so as to fit around a food product. Deformation of the material causes the slits to open. This known material has been found in certain circumstances to have the disadvantage that it can be difficult for a person to position the material around a food product satisfactorily to ensure that the product within the material is heated in a controlled manner, such that the exposure of the food product to the radiation is within desired limits, and that the characteristics of the heated food product are optimised.

According to the present invention, it has been found that a food product can be exposed to microwave radiation so that the inner regions of the product are suitably heated, and that the surfaces of the product are dried and made crisp, by placing the product in a tray with a lid having a plurality of openings extending through it, and being so folded that the distance through the openings from one side to the other side of the lid is greater than the thickness of the lid material.

Accordingly, in one aspect, the invention provides a container for use in connection with the exposure of edible matter to microwave radiation, which comprises a base tray and a lid, the lid being formed from a sheet of a material which absorbs microwave radiation and is heated by it, the lid having a plurality of openings extending through it, and being so folded or constructed that the distance through the openings from one side to the other side of the lid is greater than the thickness of the material of the lid.

The container of the invention has the advantage that the external surface of a product can be exposed directly to hot dry air, which has a low relative humidity, so that evaporation of water from the surface of the product is facilitated. Water vapour which results from evaporation of moisture on the surface of a product exposed to microwave radiation can then be removed from the product through the openings in the lid so that the surface of the product can acquire a low surface moisture content, and therefore also to be crisp.

Furthermore, the presence of the base tray as a component of the container allows a food product to be packaged in the container in which it is to be prepared for consumption, so that it can be passed from the original manufacturer, through the relevant retail chain, to the person who is to heat the product, and then be heated without having to be removed from its original container. This represents a significant advantage since handling of the food product is minimised during transportation and prior to heating, so that the likelihood of damage to the product prior to heating is reduced. This can be particularly advantageous when the food product is fragile at least prior to heating, which can be the case with many pastry products, with which the container of the invention is particularly well suited for use.

A further significant advantage of packaging a food product in a container in which it can be heated is that the heating of the product by the consumer is made easier; it is necessary for the consumer only to remove any outer wrapping from the container and to fix the lid over the base (if this has not been done already), prior to heating the product in a microwave oven. This is entirely consistent with the desire to provide easily prepared meals quickly, with minimum handling and expenditure of time.

Preferably, the distance through the openings from one side to the other side of the lid is at least about 5 times greater than the thickness of the material of the lid, more preferably at least about 10 times greater. In this way, the function of the openings becomes similar to that of an array of chimneys. Convection currents generated within the container can facilitate removal of moisture from the surface of the food product, and the convection currents are enhanced by the use of a material for the lid of the container which is folded to provide relatively long chimneys.

The openings in the lid may be provided as slits. The slits will generally extend approximately parallel to one another. Preferably, the slits are arranged in parallel lines, with non-broken film between pairs of slits in each line. It is preferred that slits in a first line overlap with non-broken film located between respective pairs of slits in an adjacent second line. Openings provided in a lid in the form of slits with these preferred features can be opened so that the distance through the openings from one side to the other side of the lid is greater than the thickness of the film, simply by pulling the lid in a direction substantially perpendicular to the lines of the slits.

The slits in the lid of the container may have an arcuate configuration. For example, the slits may be arcuate in the sense that they are defined by a constant radius along their length. Other configurations of curved slits are envisaged. It can be preferred for the configuration of the arcuate slits to be varied over the surface of the lid. For example, the degree of curvature of the slits may vary from one slit to another, or from one region of the lid to another.

The provision of slits in the lid having an arcuate configuration has the advantage that it allows the lid to conform to the shape of the food product more closely. A further advantage is that it has been found that the lid has a reduced tendency to flare outwardly at its ends.

The lid may have a plurality of substantially parallel lines of weakness extending across it along which the lid is or can be folded, and openings extending through the lid along at least every alternate line of weakness. A lid with openings having this configuration can have the advantage that the space under the lid for hot air, between the lid and the upper surface of the food product, is greater than in the case of a sheet in which openings are formed by stretching a sheet which remains substantially in one plane.

A further advantage of a lid with openings along spaced apart lines of weakness is that the openings in the lid are formed during manufacture of the lid, so that the configuration of the openings can be controlled. This can be contrasted with susceptor products in which openings are formed by stretching when they are wrapped around a food product by a consumer immediately prior to exposure to radiation.

Preferably, the openings are spaced apart substantially regularly along the lines of weakness.

The size of the openings in the lid will be selected according to factors such as the amount of moisture which it is desired to allow to be lost from the surface of a food product in the container. It has been found appropriate for the ratio of the transverse dimension of the openings to the distance between adjacent lines of weakness has a value less than about 1.5, preferably less than about 1.0. Preferably, the value of the ratio is at least about 0.5, especially at least about 0.8. Generally, the openings will be centred on the apices of the corrugations in the lid.

Preferably, the openings in the film are generally rounded, for example approximately circular.

Openings in the lid may be defined by at least three flaps arranged around the opening, and the flaps being folded out of the plane of the lid.

The lid is formed from a material which absorbs microwave radiation and is heated by it. Such materials are sometimes referred to as "susceptor materials". For example, the lid may comprise a layer of a metal, for example in a metallised polymeric film. The metal may be applied by vacuum deposition, for example of a metal such as aluminium. A suitable material is disclosed in GB-A-2046060.

The lid may comprise other microwave absorbent materials, such as certain ferromagnetic materials, and materials which have a carbon based coating.

When the lid comprises a metallised polymeric film, the polymer is preferably a polyester. The film may include a laminated layer of paper. The paper may serve as a support for the film, and may be a stiffened paper, for example a card, in order to provide the desired degree of support.

It can be preferred in many circumstances for both the lid and the base of the container to be made from one or more susceptor materials, which absorb microwave radiation and are heated by it.

Preferably, the lid is attached to the base of the container along at least part of one edge of the base. The lid and the base may be formed as a single article, being joined along a fold line.

It is preferred that the lid and the base of the container are provided with means by which the lid can engage the base to close the container. For example, the lid and the base can be provided with cooperating formations, such as tabs and slots, or wrap over portion on the lid to engage a rim on the base.

It can be convenient for the base of the container to be formed from the same material as that of the lid, particularly when the lid and the base are joined to one another. The formation of the base from a susceptor material has been found to enhance the heating effect of the microwave radiation on a food product within the container, while the lid can provide the venting which can give rise to a crisp product. Indeed, generally it has been found to be possible for the base not to have any openings in its walls, and for the characteristics of a food product heated in container not to be affected adversely. This has the advantage that fluid which seeps from the food product while it is being heated can be collected in the container, without dirtying the interior of the microwave oven or any need to use a secondary container.

The base of the container may be formed by folding a sheet of a suitable material. The container may be retained in its folded configuration by use of a system of interlocking formations, for example in the form of tabs and slits. Alternatively the container may be retained in its folded configuration by use of an adhesive.

The base of the container may be formed by moulding, for example, by injection moulding. This has the advantage of providing by a simple technique a base which can collect fluid which seeps from a food product as it is heated.

In another aspect, the invention provides a method of exposing edible matter to microwave radiation, which includes the step of placing the matter within a container of the type discussed above. The method may include the step of stretching the lid of the container to cause openings in it to open.

Embodiments of the present invention will now be described, by way of example, with reference to the accompanying drawings, in which.

Figure 4A:
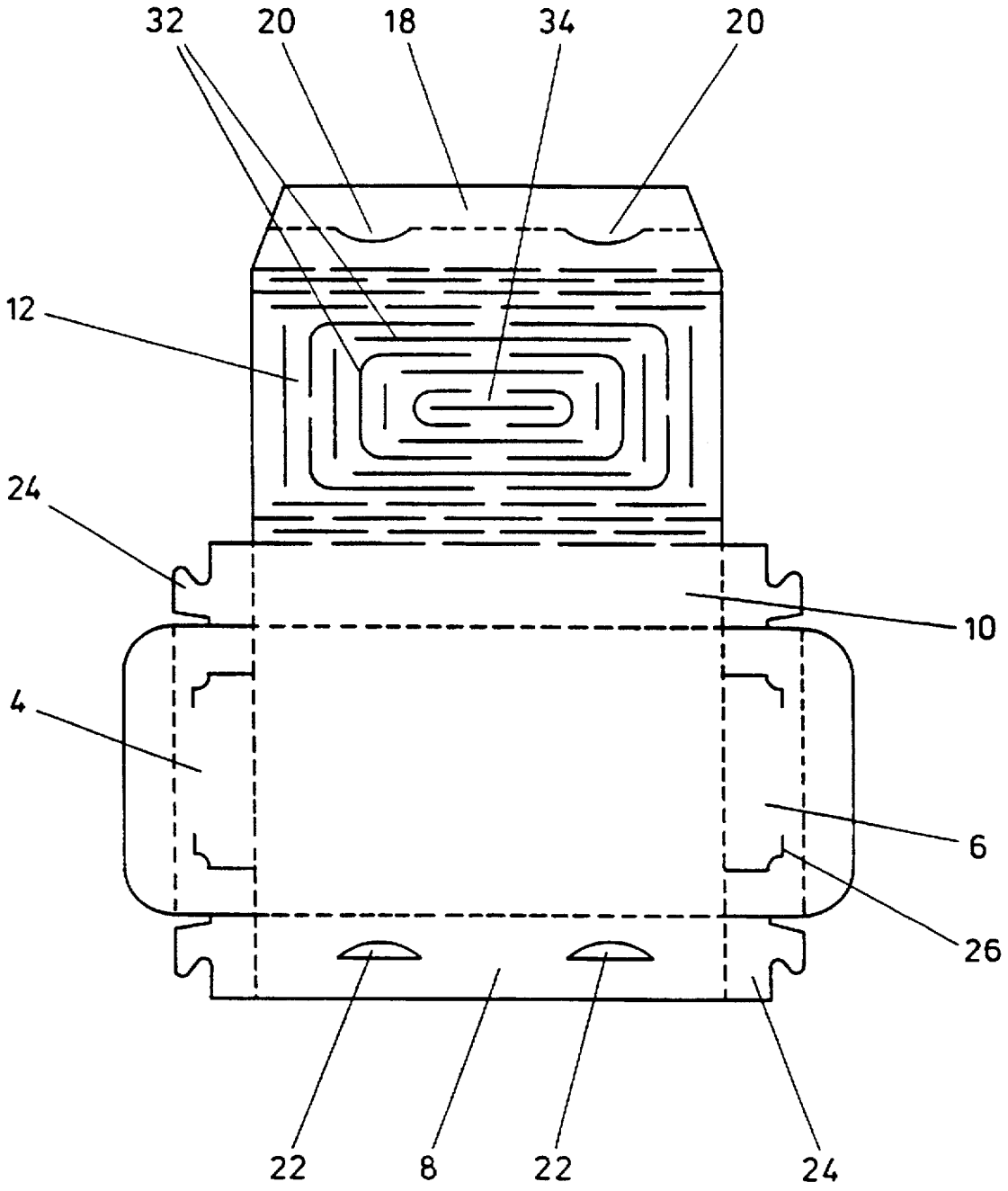
Figure 4B:
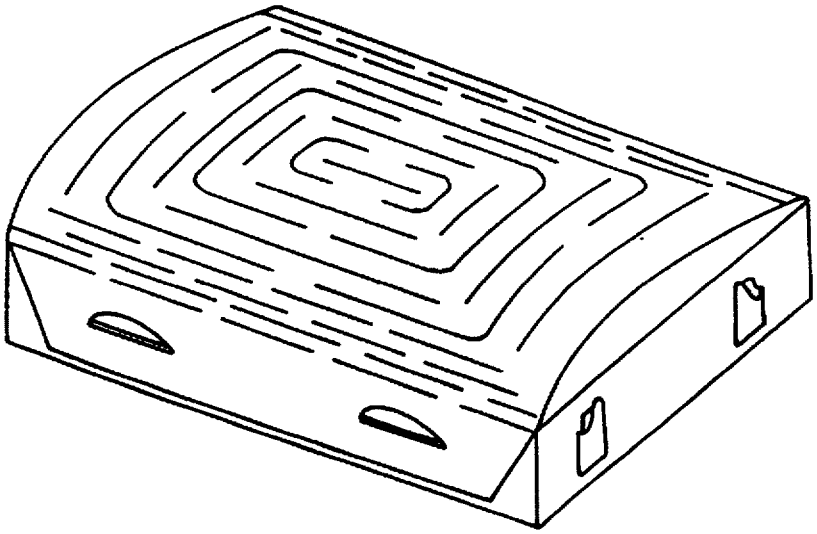
Figure 5:
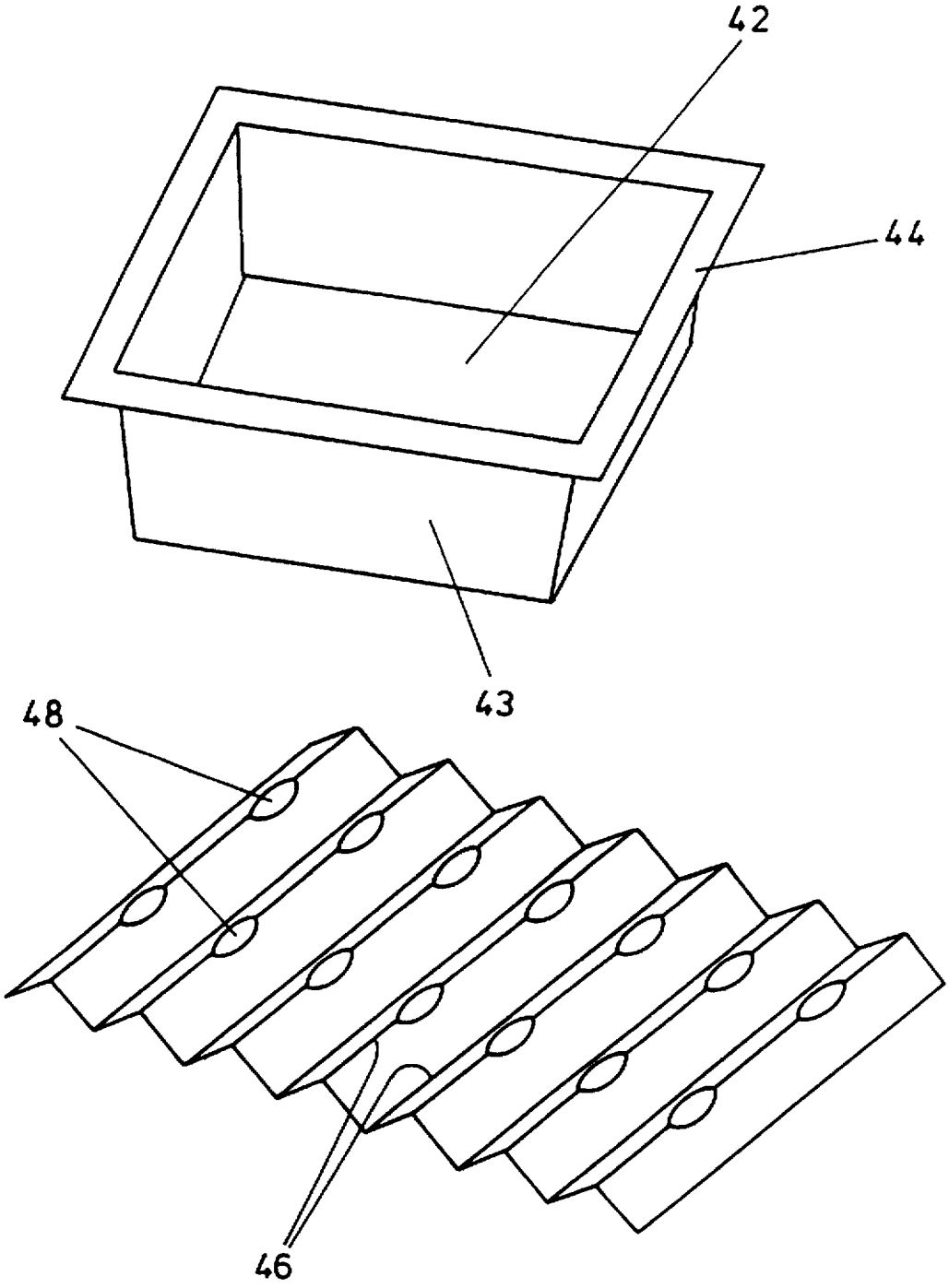

FIGS. 4*a* and 4*b* are plan and isometric views respectively of another embodiment of container; and FIG. 5 is an isometric view of a further embodiment of container.

Figure 1:
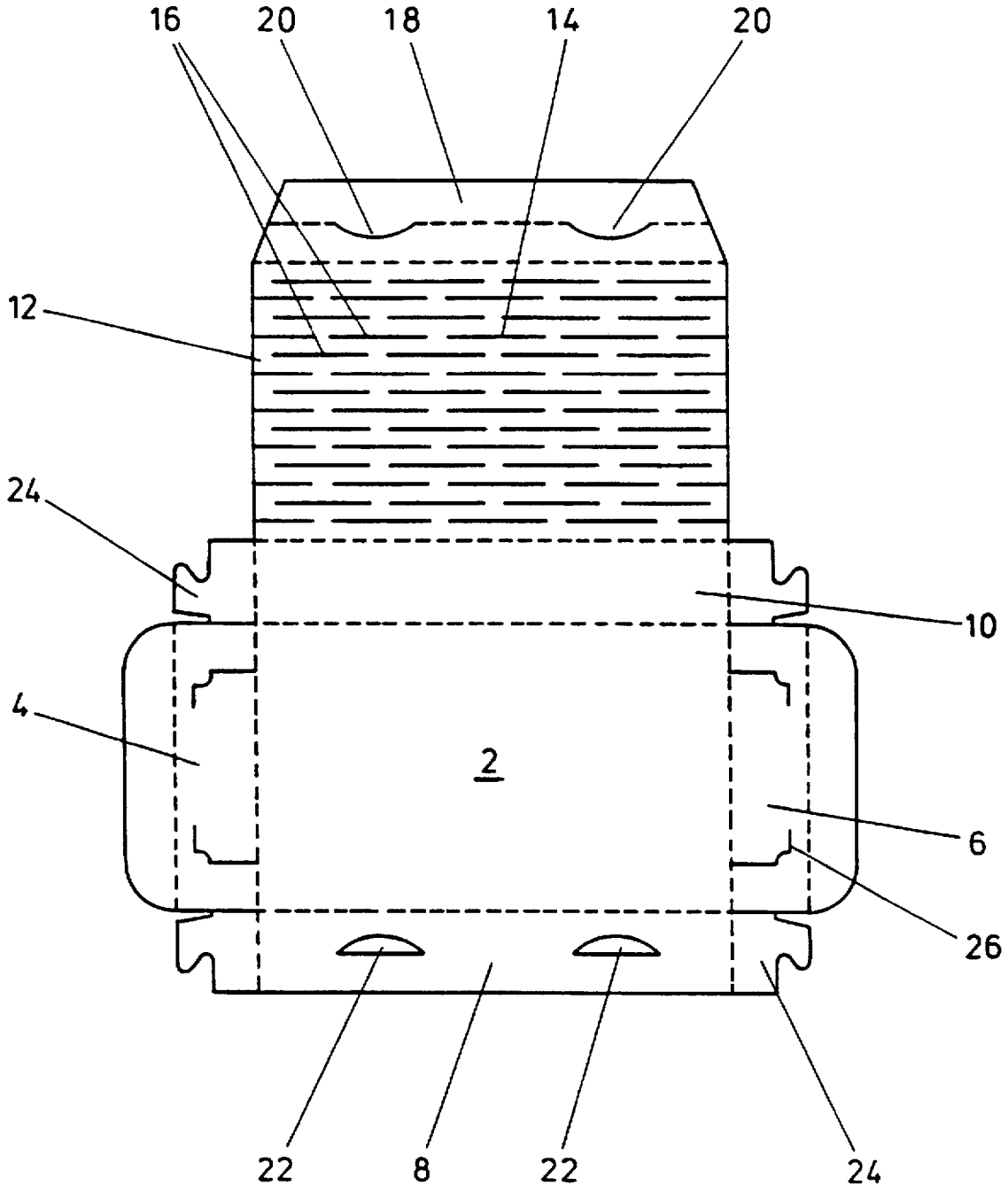
FIG. 1 is a plan view of a cut sheet of card, from which a container can be formed.

Referring to the drawings, FIG. 1 shows a cut blank formed from a sheet of susceptor material, which can be folded to form a container. The material comprises a metallised polyester film which has been laminated to a sheet of card, the metal surface of the film being in contact with the card.

The blank comprises a base portion 2, end walls 4, 6, and front and back walls 8, 10 respectively.

A lid 12 is connected to the back wall 10. The lid is formed with a plurality of slits 14 arranged in parallel lines 16. Non broken lid material exists between pairs of slits in each line. Slits in a first line overlap with non-broken lid material located between respective pairs of slits in an adjacent second line. This arrangement of slits allows openings to be formed in the lid by stretching the lid in a direction substantially perpendicular to the lines 16 of slits.

An edge portion 18 of the lid 12 is provided with a pair of tabs 20. The tabs are sized and located so as to engage recesses 22 in the front wall 8 of the base 2.

Each of the front and back walls 8, 10 has tabs 24, which can engage appropriate slits 26 in the end walls 4, 6, when the base is assembled.

Figure 2:
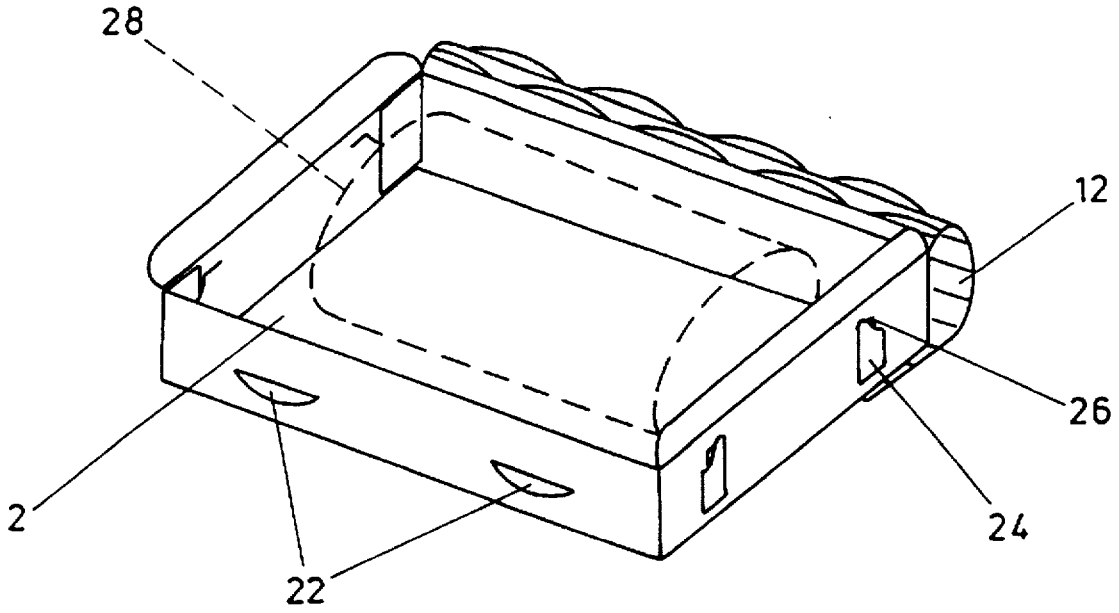
FIG. 2 is an isometric view of a container formed from the sheet shown in FIG. 1, before its lid is closed.

FIG. 2 shows the blank shown in FIG. 1 after it has been folded, and after the tabs 24 have been engaged with the slits 26, to lock the base into its folded configuration. The container is arranged with the polymer surface of the sheet disposed internally, and the paper surface of the sheet disposed externally.

A food product 28 can be placed in the container once it has been assembled, to have the configuration shown in FIG. 2. The lid can be retained below the base, by folding the lid away from the upper surface of the container. The food product can be packaged in the container by means of an external wrap. The wrap can be transparent, at least from above, so that the food product can be inspected by a consumer prior to purchase.

Before heating food product using the container shown in FIG. 2, any outer wrapping material is first removed. The lid is then drawn over the base to cover the food product. As it is drawn over the base, the slits in the lid are opened, and a 3-dimensional array of openings is formed. The openings can be considered to be chimneys, the distance through the openings from one side of the lid to the other side thereof being at least five times greater than the thickness of the material of the lid. The lid is fastened over the base by locating the tabs 20 in the recesses 22 on the front wall 8.

Figure 3:
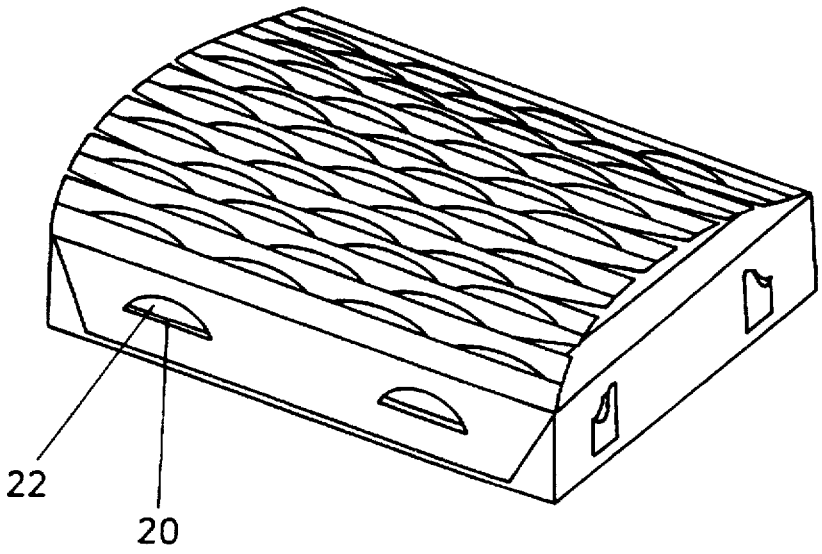
FIG. 3 is an isometric view of the container shown in FIG. 2, with the lid closed.

The container is shown in FIG. 3, after the lid has been closed.

Exposure of the container, and the food product within it to microwave radiation causes the food product to be heated. Water vapour from the food product during the heating process escapes from the container through the openings in the lid, enhanced by convection currents within the container.

FIG. 4*a* shows a cut sheet of card which can be used to form a container, in a manner similar to that in the container of FIGS. 1 to 3. The pattern of openings in the lid differs from that in the container of FIGS. 1 to 3. A pattern of slits 32 is formed in the lid 12. The slits allow the lid to be deformed out of a single plane, by the application of force to a point 34 at the centre of the lid. This deformation takes place before the lid is drawn over the base to cover a food product. The closed container is shown in FIG. 4*b*, without a bulky object within the container, which would cause the lid of the container to be deformed upwardly in its centre, opening the slits.

FIG. 5 shows a container which comprises a moulded base 42, which might be formed for example from a polymeric material such as a polyethylene terephthalate, upstanding walls 43, and a lip or flange 44 extending around the upper edge of the walls 43.

The lid of the container is provided in the form of a sheet of a metallised polymeric film. The film has parallel lines of weakness 46 extending across it, along which it can be folded to form a corrugated structure. The film has a plurality of openings 48 in the form of circular perforation. The openings are arranged in parallel lines on alternate ones of the lines of weakness. When the film is folded to form a corrugated structure, the openings are located on the peaks of the corrugation.

A food product can be supplied to a consumer within the base 42. The base may be placed on the lid before the assembly is overwrapped for shipping. Preferably, the overwrapping material is transparent to allow the food product to be inspected by a prospective purchaser.

Prior to heating, any wrapping material located around the base and lid is removed. The lid is then folded to form a corrugated structure, and placed on top of the base 42 so as to engage and overlie the lip 44. The container with the food product is then placed in a microwave oven, and the food product subjected to microwave radiation, by which it is heated.

The invention is not restricted to the designs of lid shown in the drawings, and other forms of lid may be used within the definition of the invention claimed herein.

We claim:

1. A container for use in connection with the exposure of edible matter to microwave radiation, which comprises a base tray and lid, the lid comprising a sheet of a material which absorbs microwave radiation and is heated by it, the lid having a plurality of openings extending through it, and being so folded or constructed as to define a distance through the openings from one side to the other side of the lid, the said distance being greater than the thickness of the sheet of the material.

2. A container as claimed in claim 1, in which the said distance is at least about 5 times greater than the thickness of the material of the lid.

3. A container as claimed in claim 1, in which the openings are provided as slits.

4. A container as claimed in claim 3, in which the slits extend approximately parallel to one another.

5. A container as claimed in claim 4, in which the slits are arranged in parallel lines, with non-broken lid material between pairs of slits in each line.

6. A container as claimed in claim 5, in which slits in a first line overlap with non-broken lid material located between respective pairs of slits in an adjacent second line.

7. A container as claimed in claim 1, in which the lid has a plurality of substantially parallel lines of weakness extending across it along which the lid is or can be folded, and openings extending through the lid along at least every alternate line of weakness.

8. A container as claimed in claim 7, in which the openings are spaced apart substantially regularly along the lines of weakness.

9. A container as claimed in claim 7, in which the ratio of the transverse dimension of the openings to the distance between adjacent lines of weakness has a value which is less than about 1.5.

10. A container as claimed in claim 1, in which openings in the lid are defined by at least three flaps arranged around the opening, and the flaps being folded out of the plane of the lid.

11. A container as claimed in claim 1, in which material of the lid comprises a metallised polymeric film.

12. A container as claimed in claim 11, in which the film includes a laminated layer of paper.

13. A container as claimed in claim 11, in which the polymer of the film comprises a polyester.

14. A container as claimed in claim 1, in which the lid is attached to the base along at least part of one edge of the base.

15. A container as claimed in claim 1, in which the base is formed from the same material as that of the lid.

16. A container as claimed in claim 1, in which the base is formed by folding.

17. A container as claimed in claim 1, in which the base is formed by moulding.

18. A method of exposing edible matter to microwave radiation, which includes the step of placing the matter within a container which comprises a base tray and a lid, the lid comprising a sheet of a material which absorbs microwave radiation and is heated by it, the lid having a plurality of openings extending through it, and being so folded or constructed as to define a distance through the openings from one side of the lid to the other side of the lid such that said distance is greater than the thickness of the sheet of the material.

19. A method as claimed in claim 18, which includes the step of stretching the lid of the container to cause the openings to open.

* * * * *